United States Patent [19]

Inoki

[11] Patent Number: 4,811,909

[45] Date of Patent: Mar. 14, 1989

[54] BALL MILL

[75] Inventor: Masahiro Inoki, Hirakata, Japan

[73] Assignee: Hosokawa Micron Corporation, Osaka, Japan

[21] Appl. No.: 25,898

[22] Filed: Mar. 13, 1987

[30] Foreign Application Priority Data

Mar. 18, 1986 [JP] Japan ..... 61-61846

[51] Int. Cl.[4] ..... B02C 17/16

[52] U.S. Cl. ..... 241/33; 241/57; 241/65; 241/172; 241/285 B

[58] Field of Search ..... 366/102, 107, 149, 292, 366/325, 279, 331; 241/33, 46.17, 57, 172, 171, 65, 66, 67, 285 R, 285 B, 199.12, 175

[56] References Cited

U.S. PATENT DOCUMENTS

| | | | |
|---|---|---|---|
| 654,961 | 7/1900 | Emory | 366/325 |
| 673,143 | 12/1901 | Sette | 366/325 X |
| 3,887,142 | 6/1975 | McElvain | 241/171 X |
| 4,607,801 | 8/1986 | Harvey | 241/175 X |

FOREIGN PATENT DOCUMENTS

| | | | |
|---|---|---|---|
| 1350956 | 12/1963 | France | 241/46.17 |
| 21635 | 2/1981 | Japan | 366/102 |
| 74131 | 5/1983 | Japan | 366/102 |
| 594294 | 2/1978 | U.S.S.R. | 241/172 |

*Primary Examiner*—Mark Rosenbaum
*Attorney, Agent, or Firm*—Edwin E. Greigg

[57] ABSTRACT

A ball mill comprising a container for receiving a material to be pulverized and pulverizing balls, and an agitator including arms rotatable on a vertical axis. The arms carry elongate agitating members extending along and revolvable about the vertical axis. All of the arms are disposed in a position above the material and the balls in the container. The agitating members are arranged substantially equidistantly on a circle or circles around the vertical axis. The container defines gas inlet ports in a bottom region thereof for receiving a gas during a pulverizing operation.

16 Claims, 4 Drawing Sheets

(a)

(b)

(a)

(b)

BALL MILL

BACKGROUND OF THE INVENTION

The present invention relates to a ball mill for pulverizing various materials such as ferrite, metal powder, minerals, foods and the like to finer particles, the material to be pulverized being placed in a container together with pulverizing balls and agitating forces being applied to the material and the balls. More particularly, the invention relates to an improvement in a ball mill comprising a container for receiving a material to be pulverized and pulverizing balls, and an agitator including arms rotatable on a vertical axis and carrying elongate agitating means extending along and revolvable about the vertical axis.

A known ball mill of this type is disclosed, for example, in Japanese Patent Publication No. 45-22280. This prior art ball mill will be described first with reference to FIG. 7 of the accompanying drawings. The ball mill comprises a container 25 housing a vertical rotary shaft 26. The rotary shaft 26 carries a plurality of arms 27 all disposed in a space filled with a material to be pulverized and the balls. Each of the arms 27 carries an agitating member 28 standing upright thereon.

In the known construction, not only the agitating members for imparting agitating forces but also the arms for supporting the agitating members are disposed in the space filled with the material and balls to revolve with the agitating members. This construction, therefore, has the disadvantages that the speed of pulverization is slow for the power consumption and that the balls become worn quickly.

SUMMARY OF THE INVENTION

An object of the present invention is to provide a ball mill capable of speedy and satisfactory pulverization while checking wear of the balls, by finding the causes of the drawbacks of the prior art noted above.

In order to achieve this object, a ball mill according to the present invention comprises a container and an agitator, the agitator including arms rotatable on a vertical axis, and elongate agitating members attached to the arms to extend along the vertical axis and to be revolvable about the vertical axis, wherein all of the arms are disposed in a position above the material and balls placed in the container.

In order to find the causes of the drawbacks of the prior art, various types of agitator have been prepared and tested to compare their performance. The experiment has proved that, where all or part of the arms are placed to revolve in the space of the container filled with the material and balls, the mill consumes a great amount of power, has a low pulverization speed and wears the balls intensively. This appears due to the fact that the arms which by nature have a construction ill suited to the agitating action are disposed in the space filled with the material and balls and play a part in the agitating function.

In contrast, the ball mill according to the present invention has all of the arms disposed at a position above the space filled with the material and balls. Therefore, these arms do not produce an adverse influence on the agitating action. It has been confirmed through various comparative tests that the ball mill according to the present invention is capable of a speedy and satisfactory pulverizing operation with a reduced power consumption while checking the wear of the balls.

Consequently, the ball mill provided by this invention can perform an energy-efficient pulverizing operation which necessitates reduced energy and ball changing costs. This ball mill is a notable improvement on the known counterpart in all of performance, running cost and management aspects.

The ball mill according to the present invention may include gas supply means for supplying a gas into the container during a pulverizing operation. The gas supplied into the container during a pulverizing operation reduces the apparent viscosity of the material under treatment to promote active movements of the balls. The balls thus activated have increased opportunities to collide with one another and have increased colliding forces too. Therefore, an excellent pulverizing operation is carried out while achieving further power saving. This, combined with the effect produced by disposing all of the arms above the area filled with the material and balls, further promotes the advantages in the performance, running cost and management aspects.

Other features and advantages of the present invention will be apparent from the following description.

BRIEF DESCRIPTION OF THE DRAWINGS

FIGS. 1 through 6 of the drawings illustrate ball mills embodying the present invention, in which:

FIG. 1 is a front elevation of a ball mill,

FIG. 2 is a side elevation, partly broken away, of the ball mill,

FIG. 3 is a sectional view of a principal portion of the ball mill,

FIG. 4 is a plan view of the principal portion,

FIGS. 5(*a*) and (*b*) are plan views of the principal portion according to different embodiments, and FIGS. 6(*a*) and (*b*) are sectional views of the principal portion according to further embodiments.

DESCRIPTION OF THE PREFERRED EMBODIMENTS

Figure 1:
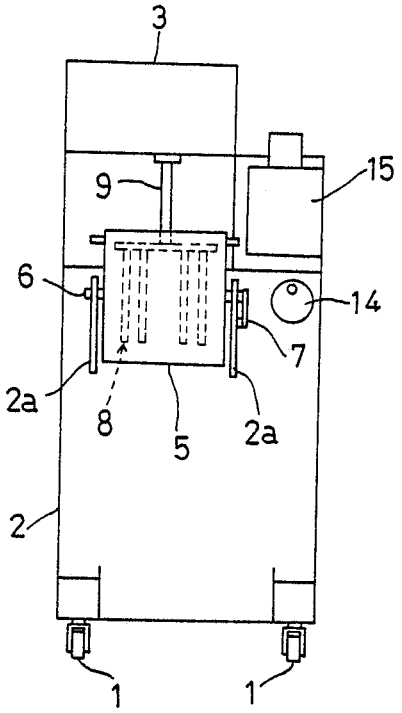
Figure 2:
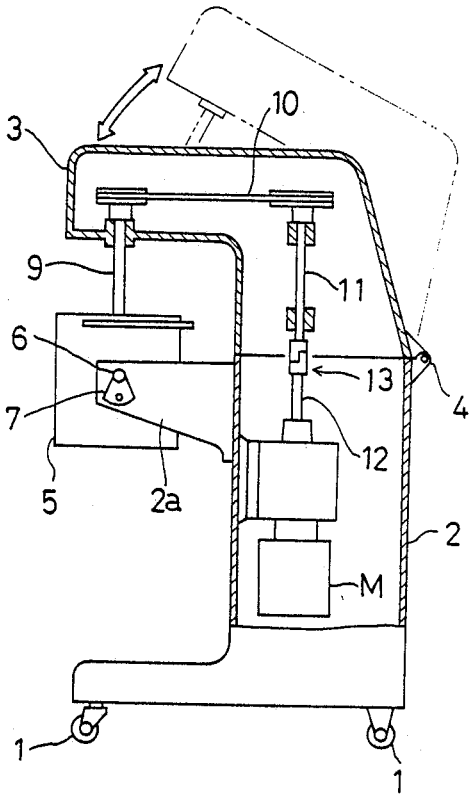

As shown in FIGS. 1 and 2, a ball mill according to the present invention comprises a lower case 2 having casters 1, and an upper case 3 attached to the lower case 2 to be vertically pivotable on hinges 4. A container 5 is attached to brackets 2*a* of the lower case 2 through support rods 6 to be rotatable on the support rods 6 to discharge contents of the container 5. A lock 7 is provided for maintaining the container 5 in a pulverizing position in which the container 5 has an opening directed substantially straight upward. The lock 7, for example, comprises a bolt and nut attached to the container 5 for releasably fixing the container 5 to the brackets 2*a*.

An agitator 8 placed in the container 5 is attached to a lower end of a rotary support shaft 9 attached to the upper case 3. The agitator 8 extends substantially straight downward when in agitating action. The upper case 3 includes a rotary shaft 11 operatively connected to the rotary support shaft 9 through an endless transmission device such as a belt 10. The rotary shaft 11 is operatively connected to an output shaft 12 of an electric motor M having a reduction mechanism mounted in the lower case 2. The shafts 11 and 12 are operatively connected through a clutch 13 which is engageable and disengageable with vertical pivotal movements of the upper case 3. The lower case 2 carries a control box 15 including a handle 14 for operating the reduction mechanism, a switch for starting and stopping the motor M, meters and the like.

For carrying out a pulverizing operation with this ball mill, the container 5 is fixed to the pulverizing position, the upper case 3 is lowered to place the agitator 8 in the container 5, a material to be treated and pulverizing balls are filled to an appropriate level in the container 5 (to 60–70% of the container height, for example), and a lid 16 consisting of two parts is placed on the container 5. Then the motor M is switched on to revolve the agitator 8 (at a 2–3 m/sec. agitating speed, for example) for pulverizing the material by the action of balls (to about 0.5 micrometers, for example). When the pulverizing operation is completed, the agitator 8 is stopped, the lid 16 is removed, the upper case 3 is raised, and the container 5 is rotated to discharge the material and balls from the container 5.

Figure 4:
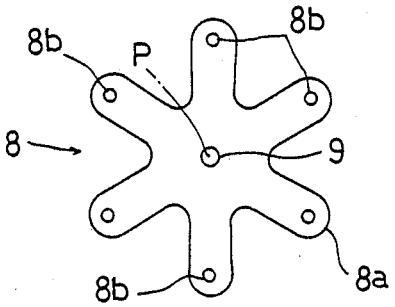
Figure 3:
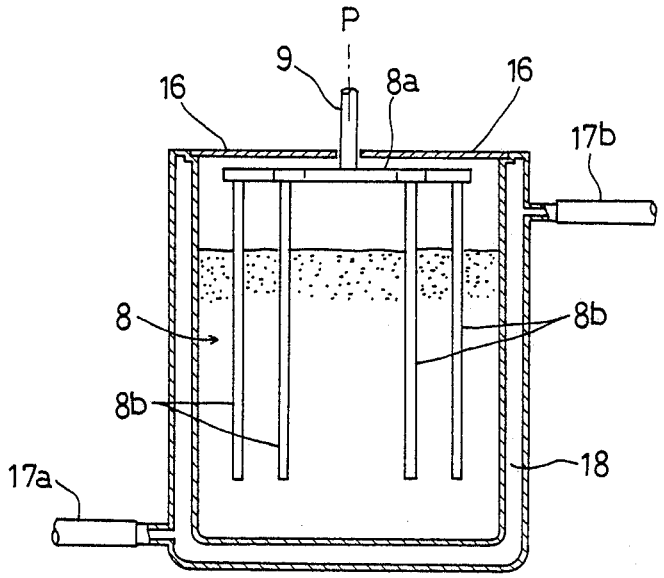

As shown in FIGS. 3 and 4, the container 5 includes a cooling water jacket 18 to which a cooling water supply hose 17*a* and an exhaust hose 17*b* are connected, to check a temperature rise in the container 5 resulting from the pulverizing operation.

The agitator 8 comprises arms 8*a* attached to the rotary support shaft 9 to be rotatable on a vertical axis P, and elongate agitating members 8*b* extending along the vertical axis P. The agitating members 8*b* are fixed to and depend from the arms 8*a*, and are arranged substantially equidistantly on a circle around the vertical axis P. The arms 8*a* are disposed at a position above the material to be pulverized and the balls in the container 5, with only the agitating members 8*b* extending into an interior space filled with the material and balls to revolve about the vertical axis P. This construction ensures an efficient pulverizing operation and checks wear of the balls.

The material to be pulverized may be selected from ferrite, foods, metal powder, pigments, ink, minerals and other suitable articles.

The balls may be formed of a suitable material such as steel, ceramics, glass and the like. Each ball may have a selected suitable size which, generally speaking, is 1–10 mm and desirably 2–3 mm.

Figure 5:
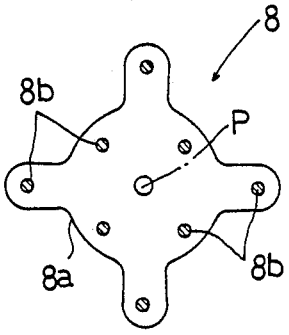
Figure 5:
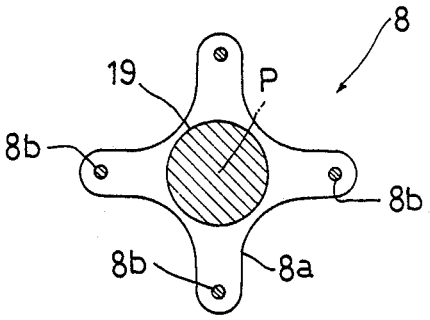

The shape and number of arms 8*a* may be varied as desired in accordance with the number and arrangement of agitating members 8*b*. Only one agitating member 8*b* may be provided instead of a plural number, and the material, shape and arrangement thereof are selectable in various ways. As shown in FIG. 5 (*a*) for example, the agitating members 8*b* may be distributed to a plurality of circles around the vertical axis P. As shown in FIG. 5 (*b*), the agitating members 8*b* may be arranged around a hollow or solid member 19 attached to the agitator 8 or the container 5, which is suitable where the container 5 has a large diameter. Where the member 19 is attached to the container 5, it is desirable for the member 19 to include a cooling jacket.

The agitating members 8*b* may have various postures. For example, the following postures (a) to (d) may be employed individually or in a suitable combination for part or all of the agitating members 8*b*:

(a) Inclined to have lower portions disposed progressively forwardly with respect to a revolving direction, (b) Inclined to have the lower portions disposed progressively rearwardly with respect to the revolving direction, (c) Inclined to have the lower portions disposed progressively outwardly with respect to a radius of revolution, and (d) Inclined to have the lower portions disposed progressively inwardly with respect to the radius of revolution.

Where, for example, the agitating members 8*b* are inclined to have the lower portions disposed progressively forwardly with respect to the revolving direction as well as radially inwardly, the revolution of agitating members 8*b* will generate component forces acting upwardly and inwardly to slightly lift the material under treatment and the balls. This will greatly agitate the balls to carry out an excellent pulverizing operation. Thus, the posture of agitating members 8*b* may be varied to produce different effects in accordance with the characteristics of materials to be pulverized.

Figure 6:
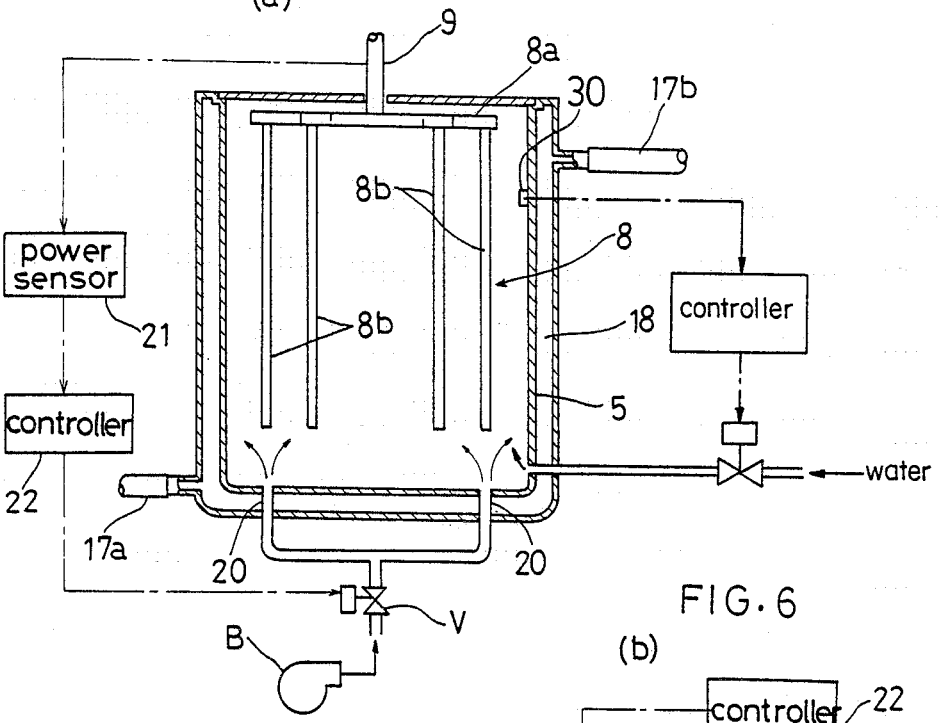
Figure 6:
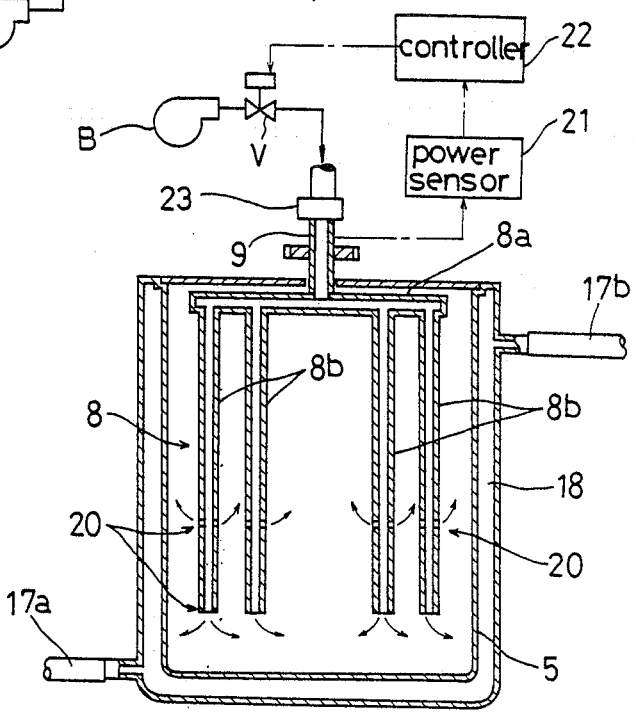
Figure 7:
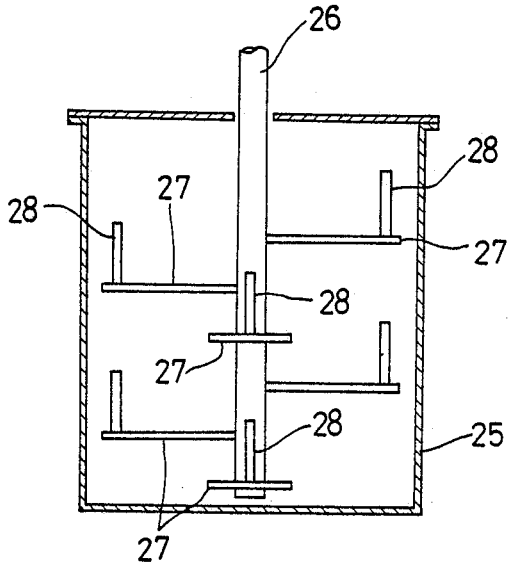
FIG. 7 PRIOR ART
FIG. 7 is a sectional view of the principal portion of a conventional ball mill.

FIG. 6 (*a*) shows an embodiment wherein the container 5 defines, at suitable positions thereof such as at the bottom or at lower lateral wall portions, gas inlet ports 20 connected to a blower B. A valve V is automatically operable by a controller 22 in response to data provided by a power detecting sensor 21 to supply gas only during the pulverizing operation. FIG. 6 (*b*) shows another embodiment wherein tubular agitating members 8*b* define gas inlet ports 20 at suitable positions thereof, and a tubular rotary support shaft 9 is connected to a blower B through a rotary joint 23. In either of these embodiments, gas is introduced into the container 5 to reduce the apparent viscosity of the material in the container 5, thereby permitting the balls to make active movements for an energy-efficient pulverizing operation. The balls thus activated have increased opportunites to collide with one another with increased impact.

The ball mill per se may be the wet type or dry type. In the case of wet type for example, water supply means may be provided which is automatically operable by a controller to replenish the container 5 with water when a detection value of the power detecting sensor 21 exceeds a predetermined value. Alternatively, the water supply means may be automatically operable by a controller such as described above for the gas supply to the container to replenish the container 5 with water to maintain a detection value of a level detecting sensor 30 for detecting levels of the material under treatment in the container 5 within a predetermined range, thereby preventing a decrease in the amount of water in the container 5. This construction is particularly effective where gas is supplied to the material under treatment in the container 5 and bubbling caused by the gas supply tends to greatly decrease the amount of water.

The specific overall construction of the ball mill may be varied in many ways as desired. For example, a material feed duct and a pulverized product recovery duct may be connected to the container 5 at vertically or transversely opposite sides thereof to enable a continuous wet type pulverizing operation.

I claim:

1. A ball mill comprising a lower housing and an upper housing secured to said lower housing by a hinge for movement of said upper housing relative to said lower housing, a container (5) supported by said lower housing and rotatable relative thereto for receiving a material to be pulverized and pulverizing balls, an agitator supported by said upper housing and driven by a drive means, said agitator including arms (8*a*) rotatable on a vertical axis (P) and carrying elongate agitating means (8*b*) extending along and revolvable about the vertical axis (P), all of the arms (8*a*) being disposed in position relative to the material and the balls in the container (5), said upper housing being movable relative to said lower housing for inserting and removing said agitator into and outer of said container, gas supply means for supplying a gas into the container (5) during a pulverizing operation, said gas supply means including gas inlet means (20) disposed in a bottom region of the container (5) and a blower (B) connected to the gas inlet means (20), said container further including water inlet means for supplying water thereto, means for controlling the flow of water, and control means in said container for controlling the height of the water within the container.

2. A ball mill as claimed in claim 1 wherein the agitating means (8*b*) is provided in a plural number and arranged substantially equidistantly on a circle around the vertical axis (P).

3. A ball mill as claimed in claim 2 wherein at least part of the agitating means (8*b*) are disposed with lower portions thereof inclined progressively forwardly with respect to a direction of rotation thereof as well as inwardly toward said vertical axis.

4. A ball mill as claimed in claim 3 which includes a water inlet means for supplying water to said container, means for controlling the flow of water and control means in said container for controlling the height of the water within said container.

5. A ball mill as claimed in claim 2 wherein the container (5) includes a tubular or solid member (19) around which the agitating means (8*b*) are arranged.

6. A ball mill as claimed in claim 5 wherein at least part of the agitating means (8*b*) are formed tubular to define gas inlet ports connected with said tubular member (19).

7. A ball mill as claimed in claim 5 wherein said member (19) defines a cooling jacket.

8. A ball mill as claimed in claim 7 which includes a water inlet means for supplying water to said container, means for controlling the flow of water and control means in said container for controlling the height of the water within said container.

9. A ball mill as claimed in claim 1 wherein the agitating means (8*b*) is provided in a plural number and arranged on a plurality of circles around the vertical axis (P).

10. A ball mill as claimed in claim 9 wherein at least part of the agitating means (8*b*) are disposed with lower portion thereof inclined progressively forwardly with respect to a direction of rotation thereof as well as inwardly toward said vertical axis.

11. A ball mill as claimed in claim 10 which includes a water inlet means for supplying water to said container, means for controlling the flow of water and control means in said container for controlling the height of the water within said container.

12. A ball mill as claimed in claim 9 wherein the container (5) includes a tubular member (19) around which the agitating means (8*b*) are arranged.

13. A ball mill as claimed in claim 12 wherein at least part of the agitating means (8*b*) are formed tubular to define gas inlet ports connected with said tubular member.

14. A ball mill as claimed in claim 13 which includes a water inlet means for supplying water to said container, means for controlling the flow of water and control means in said container for controlling the height of the water within said container.

15. A ball mill as claimed in claim 12 wherein said member (19) defines a cooling jacket.

16. A ball mill as claimed in claim 20 wherein includes a water inlet means for supplying water to said container, means for controlling the flow of water and control means in said container for controlling the height of the water within said container.

* * * * *